United States Patent [19]

Harris et al.

[11] 4,012,886

[45] * Mar. 22, 1977

[54] BAG PUSH-OFF IN-FEED METHOD

[75] Inventors: Thomas Charles Harris, Monroe; Doyle Rayford Hudson, West Monroe, both of La.

[73] Assignee: Olinkraft, Inc., West Monroe, La.

[ * ] Notice: The portion of the term of this patent subsequent to Apr. 8, 1992, has been disclaimed.

[22] Filed: Dec. 17, 1974

[21] Appl. No.: 533,492

Related U.S. Application Data

[63] Continuation-in-part of Ser. No. 408,310, Oct. 23, 1973, Pat. No. 3,875,726.

[52] U.S. Cl. ..... 53/38; 53/371; 198/610; 198/617

[51] Int. Cl.[2] ..... B65B 7/06; B65B 43/00

[58] Field of Search ..... 53/37, 38, 40, 44, 371, 53/372, 373, 139, 124 CC, 188; 198/610, 617, 24, 20 R, 106

[56] References Cited

UNITED STATES PATENTS

| | | | |
|---|---|---|---|
| 2,049,757 | 8/1936 | Baker et al. | 53/371 X |
| 2,097,447 | 11/1937 | Cundall et al. | 53/371 X |
| 2,576,472 | 11/1951 | Messmer et al. | 53/371 X |
| 2,725,168 | 11/1955 | Lindstaedt et al. | 53/188 |
| 2,962,845 | 12/1960 | Lewis | 53/37 |
| 3,805,489 | 4/1974 | Lieder et al. | 53/371 X |
| 3,875,726 | 4/1975 | Harris et al. | 53/44 |

*Primary Examiner*—Travis S. McGehee
*Assistant Examiner*—Horace M. Culver
*Attorney, Agent, or Firm*—C. Emmett Pugh; Norveli E. Von Behren

[57] ABSTRACT

An improved in-feed method for, for example, the final closing stage of a bag filling machine of the type wherein a plurality of open bags with pre-formed gusseted tops are filled with a load of loose material and the gusseted tops reformed in a rapid sequence, and the bags are subsequently sealed closed. In the inventive method one bag pushes off the preceding bag in face-to-face engagement therewith along their front and rear sides, respectively, whereby the following or pushing bag being fed in is constrained on all four sides before it begins its infeeding movement. The four-sided constraint is provided by a multiple-finger pusher in the rear, opposing guides on the sides, and the presence of the preceding bag in front in face-to-face engagement therewith. Such frontal engagement prevents the load in the intermediate, following bag from shifting forwardly under the forward force of the pusher and opening the reformed gusseted bag top.

The novel in-feed method takes place at the entrance to the bag closing station and is used in combination with an in-feed mechanism having a pivoted, movable inlet portion which initially presents open, tapered contact surfaces (FIG. 3) to the entering bag and subsequently, after a bag enters the device, presents closed, parallel contact surfaces (FIG. 4), the contact surfaces continuously moving in a longitudinal direction along the machine.

The longitudinally moving contact surfaces, formed by moving belts, position, hold and guide the top of the bag (whose gussets have previously been reformed after the bag has been filled) preliminarily to its being closed by heat sealing or, alternatively, by sewing.

10 Claims, 8 Drawing Figures

OPEN, TAPERED ENTRY DISPOSITION

CLOSED, PARALLEL DISPOSITION

PUSH-OFF SEQUENCE III

BAG PUSH-OFF IN-FEED METHOD

CROSS-REFERENCES TO RELATED PATENTS

This application is a continuation-in-part of prior co-pending application Ser. No. 408,310, filed Oct. 23, 1973 and entitled "In-Feed Device and Method", now U.S. Pat. No. 3,875,726, issued Apr. 8, 1975.

Additionally, the below listed patents are at least generally related hereto:

U.S. Pat. NO. 3,698,451, issued Oct. 17, 1972 (filed Feb. 8, 1971) to Doyle R. Hudson and entitled "Automatic Bag Opening and Filling Apparatus";

U.S. Pat. No. 3,750,721, issued Aug. 7, 1973 (filed Aug. 18, 1971) to Doyle R. Hudson and entitled "Expanding Fill Spout for Bag Filling Machine";

U.S. Pat. No. 3,830,266, issued Aug. 20, 1974 (filed Mar. 23, 1973) to Doyle R. Hudson and entitled "Drop-Down Fill Spout For Bag Filling Machine";

U.S. Pat. No. 3,755,986, issued Sept. 4, 1973 (filed Sept. 30, 1971) to Doyle R. Hudson and entitled "Gusset Reformer"; and U.S. Pat. No. 3,796,300, issued Mar. 12, 1974 (filed July 17, 1972) to Doyle R. Hudson and entitled "Multiple Finger Pushers".

The foregoing related patents and patent application are all assigned to Olinkraft, Inc., the assignee of the present application, and are directed in their disclosures to various elements or sections of a fully automatic filling machine for bags including the bag opening, filling, top reforming, moving and final in-feed portions thereof, with the preferred embodiment of the present invention being directed to an improved in-feed method used with the in-feed device in the final closing and sealing portion of the machine.

BACKGROUND OF THE INVENTION

The present invention relates to an improved in-feed method for moving a series of bags with gusseted tops and loaded with loose materials, such as for example resin granules and the like, wherein the gusseted tops are initially closed but not yet finally sealed, as the bags are individually being introduced in line into a machine, as for example a final bag closing station utilizing sewing or heat sealing means. The present invention has been found to be particularly useful in the loaded, gusseted bag handling art, especially in the transferring of the bags from a bag reforming station to the final bag closing station and especially in association with an in-feed device having tapered, pivoting, opposed in-feed arms, and hence will be discussed with particular reference thereto, although the method of the present invention is not limited to such applications.

Several types of in-feed devices and methods have been known and used before, and typical examples thereof in the bag handling art are shown in U.S. Pat. No. 3,687,790, issued Aug. 29, 1972 to T. Wehren et al; U.S. Pat. No. 3,691,968, issued Sept. 19, 1972 to Schnepf; U.S. Pat. No. 2,097,447, issued Nov. 2, 1937 to Cundall et al; and U.S. Pat. No. 2,725,168, issued Nov. 29, 1955 to Lindstaedt et al.

However, it has been found that the bags in being processed through the in-feed devices of the prior art often or at least on occasion became misaligned or wrinkled, so that when they were closed in the sewing or sealing station, the closures were improperly and/or inaccurately made or made askew. Even in the in-feed device and method disclosed in the parent application hereof (now U.S. Pat. No. 3,875,726), which represented a substantial advance in the art over the aforelisted prior art patents, the loaded bags with their reformed gusseted tops still on occasion became misaligned, so that whey they were closed in the sewing or sealing station, the closures were improperly and/or inaccurately made or made askew, particularly with certain types of loads in the bags and certain types of bag material.

In particular, when the bags were carrying a load of loosely filled materials or cargo such as for example chemical granules and the like, and/or when the bag material was relatively supple and flexible with little body rigidity, a bag top with its gusseted top reformed or closed would on occasion become partially unformed or unmade under the action of the load shifting forward when the bag was being pushed from behind by a pusher mechanism such as for example the multiple finger pushers disclosed in the Olinkraft U.S. Pat. No. 3,796,300. The shifting load would, it is believed, move forward in the bag, especially at the top thereof, creating an outward force against the leading face of the top thereof, causing the mechanically unrestrained gusseted sides of the top to puff-out thereby make reforming of gusset difficult if not impossible. Accordingly, when the bag top entered and passed through the in-feed device, the top would be mis-aligned when presented to the sealing station.

In contrast, the present invention prevents the possibility of such an occurrence by mechanically or physically restraining the bag on all four sides while heretofore the front side of the bag was completely unrestrained. Moreover, the present invention achieves this additional restraint, not by means of a separate involved mechanical device but rather in a most straightforward, economical and, in retrospect, simple manner, that is by moving a filled bag forward in at least the latter stages of processing when in face-to-face contact with the preceding filled bag, the latter serving to restrain the front of the former in their pushing engagement.

This preceding bag restraint in cooperation with the restraints provided by opposing guides on opposite sides of the machine and the rear restraint provided by the pusher itself results in the moving bag being restrained on all four sides, a unique and most desirable situation.

Were it not for the method of the present invention, one would need to provide either an additional operator or a separate moving mechanical device, with all its inherent disadvantages, to engage the front side of the bag as the bag is moved in order to achieve the same desirable constraining results of the present invention.

In combination with the four-sided constraint aspects of the present invention, the most preferred embodiment of the present method includes the use of an in-feed mechanism utilizing dual, opposed, moving belts whose supports are not static but instead, initially present a tapered configuration at the inlet portion as the bag enters it and subsequently, after the bag enters the device, presents a closed, parallel configuration as the supports are pivoted together. The combined action of both allows the in-feed station of the machine to properly guide, align and hold the bag, for proper and accurate presentation of each bag for the final closing operation.

Thus the restraining action of the present invention on the front side of the bag as the bag is moved in engagement against the preceding bag, thereby pushing the leading bag during sequential, intermittant movements of the bags through the machine, all in combination with the movement and action of the tapered, pivoting in-feed arms described more fully below and in the parent application, produces, it is believed, far greater reliability in bag sealing than ever heretofore achieved.

Thus, the present invention provides the solution to the problems of prior systems with a straightforward, reliable and relatively simple improved system without any need for hand labor or additional complex mechanical mechanisms.

Additionally, as explained more fully below, besides serving as a simple in-feed system, the present invention can also be used to perform the final reforming step for the gusseted bag top.

Finally, the in-feeding operation is performed without the need of doing it at an unreasonably high speed because of combining the final reforming and in-feeding functions in a single stage, further enhancing the reliability of performance.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is a schematic illustration of a plan view of the sequence of operation of a bag filling and closing machine utilizing the bag push-off method of the present invention, showing four staged sequences I–IV which schematically illustrate the relative positions and stages of bag configuration as the bags A–E progress in-line through the machine; while

FIG. 3 is a top, plan view of the preferred embodiment of the in-feed section of the over-all bag filling and closing machine, which serves as the preferred embodiment utilizing the method of the present invention, showing the inlet portion thereof in its open, tapered disposition, no bag being illustrated for simplicity and clarity purposes; while

FIG. 7 is a schematic representation of the configuration of the top side of a bag which has had its gusseted top initially reformed by the tucking fingers of "Gusset Reform No. 1" station; while

DETAILED DESCRIPTION OF THE PREFERRED EMBODIMENT

Figure 1:
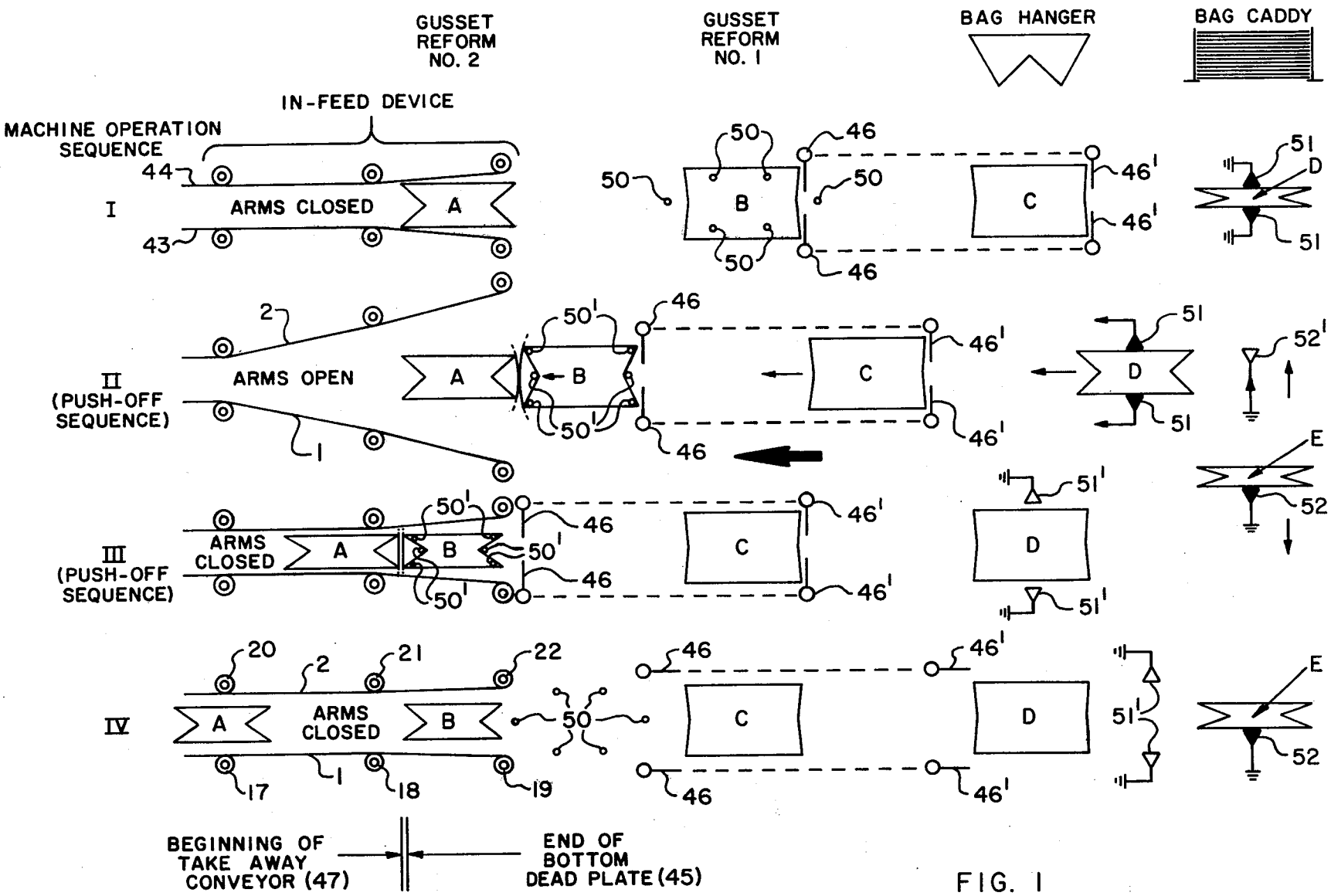
Figure 6:
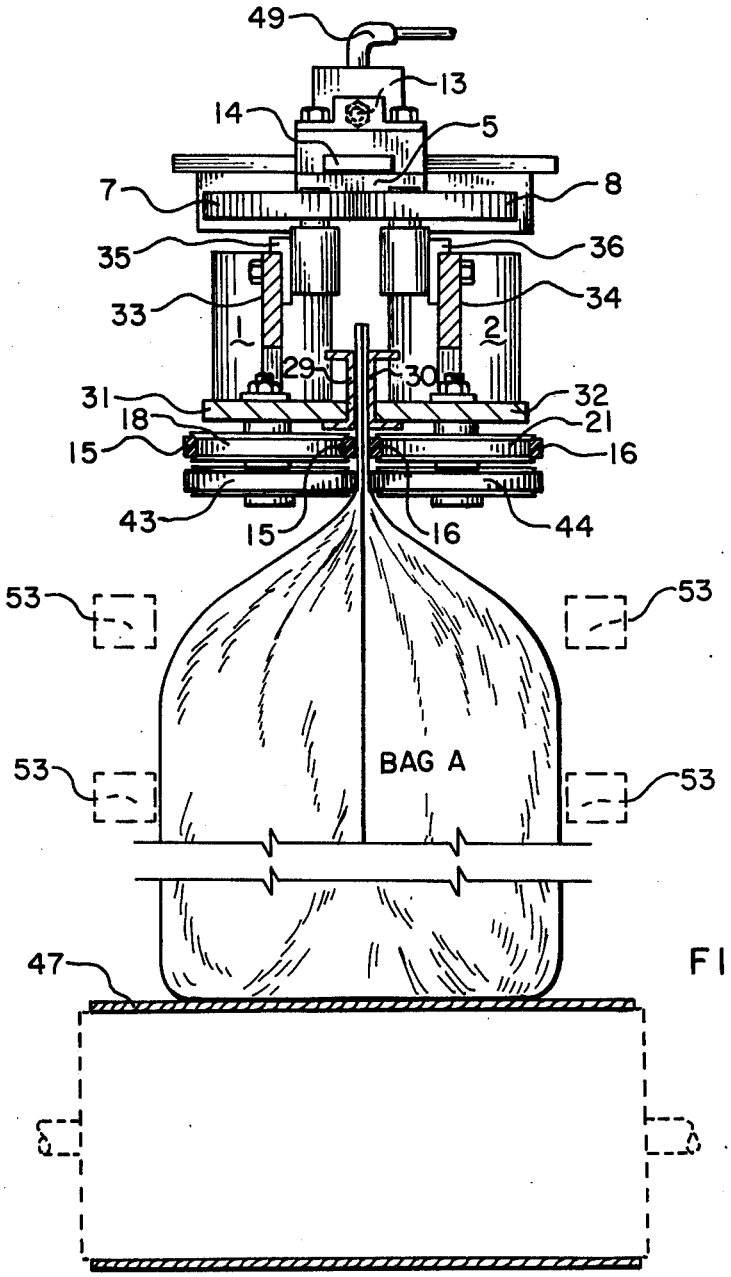
FIG. 6 is an end, cross-sectional view of the preferred embodiment, taken along broken section lines 6—6 of FIG. 5 with the bag being shown in full view.

The bag push-off in-feed method of the present invention can be utilized with any sort of gusseted bag. A particularly important area of application of the present invention is in the in-feed portion of the bag closure station which forms the final step of re-establishing the preformed gussets in a paper bag after it has been filled, and therefore the preferred embodiment of the present invention will be described with respect to such an application.

Also, the present invention is especially suited for use with the pinch style bag and the preferred embodiment will be described with respect thereto, but the present invention could be applied to almost any open mouth bag where the elimination of wrinkles in the closure area and the proper positioning of the bag are important. In the most preferred application of the present invention, the final closure of the pinch style bag is accomplished through the reactivation of the pre-applied hot melt and the folding over and securing of a top flap which is manufactured on the bag itself, and the preferred embodiment will be described with respect thereto, but the present invention is of course equally applicable to the sealing or final closing of open mouth bags by other means, such as for example a sewing process.

Additionally, the present invention is most important when precise positioning of the top is critical or highly desirable such as in the packaging of chemicals in granule form such as for example polyethylene, polyprophelyne, polycarbonate resins, etc., in heavy packages such as for example 50 pound bags. However, the use of the present invention is advantageous even where such positioning is not critical.

As generally referred to in the "Cross-References to Related Patents" supra, the preferred application of the present invention is in a bag filling machine in the very final step of re-establishing the preformed gussets in the paper bag after it has been filled and prior to its being sealed or sewn closed.

For a general understanding of the relationship of the final closing station, with the in-feed station which serves as the preferred application of the present invention, to the other stations which preceed it in the fully automatic bag filling machine of which it is a part, reference is had to U.S. Pat. No. 3,755,986 entitled "Gusset Reformer", and particularly to its FIG. 1 and its column 3, lines 19–50, and to FIGS. 1 and 2 hereof. In the over-all machine, a bag to be filled is first opened (note "Bag Caddy" station of FIGS. 1 and 2 hereof and also U.S. Pat. No. 3,698,451), filled (note "Bag Hanger" station of FIGS. 1 and 2 hereof and also the U.S. Pat. No. 3,750,721 and the U.S. Pat. No. 3,830,266 patents), and then reformed (note "Gusset Reformer No. 1" station of FIGS. 1 and 2 hereof and also U.S. Pat. No. 3,755,986), in sequence all as it is being conveyed down the machine in-line with other bags going through the same staged sequences. Then, with the use of the bag push-off in-feed method of the present invention in combination with the preferred embodiment of the in-feed device as explained more fully below, the bag in contact with the preceeding bag is moved from the bag reforming station ("Gusset Reform No. 1") to the in-feed entrance of the closing station for final sealing or sewing. The movement of the bag is achieved by the rear pushing action of a multiple finger pusher (note action of bag "B" between "Gusset Reform No. 1" station and "Gusset Reform No. 2" station in sequence II of FIG. 1, hereof and thereafter and also U.S. Pat. Nos. 3,796,300 and 3,875,726); and, finally, the preceeding bag is pushed off into the throat of the in-feed device leading into the closing station by means of the following bag (note action of bag "B" on bag "A" in going from Sequence II to Sequence III of FIG. 1 hereof). The prime function of the bag push-off in-feed method of the present invention is to insure that, when the in-feed device of the closing station grasps, guides and holds the top of the reformed bag top and properly positions it for final closing, the bag is presented to it with its gusseted top properly formed and positioned.

For a complete understanding of the present invention, the sequence of operation of the over-all machine will be initially discussed and then the structure and operation of the in-feed device which forms an auxilliary element to the in-feed method of the present invention will be described in detail. Subsequently then the use of the bag push-off in-feed method of the present invention in relation thereto will be discussed in detail.

SEQUENCE OF OPERATION OF OVER-ALL MACHINE

Figure 2:
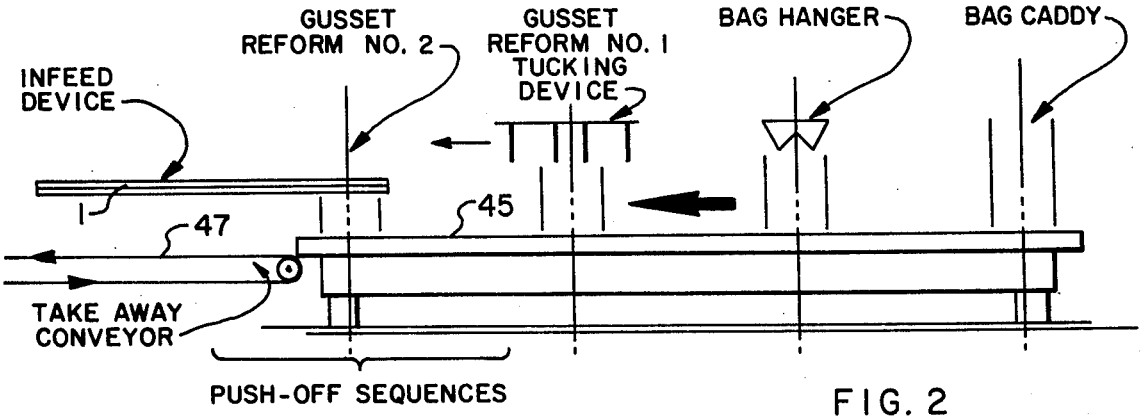
FIG. 2 is a schematic illustration of a side or profile view of the bag filling and closing machine of FIG. 1 further showing the relative positions of the various basic machine elements thereof.

As best illustrated in schematic form in FIG. 1, the bags in the over-all bag filling and closing machine go through a series of cyclical staged sequences as explained below. In order to fully understand the schematic illustration of FIG. 1, it is noted that the figure shows in schematic form four in-line stations — the initial "Bag Caddy" station, the "Bag Hanger" station, the "Gusset Reform No. 1" station, and the "Gusset Reform No. 2" station which is at the entry portion of the in-feed device; the final bag closing station not being illustrated for simplicity reasons. Bags A–E are shown in the various sequential positions as the machine goes through Sequences I–IV. It is noted that bags A–E in FIG. 1 are illustrated by schematic representations of the configuration of their tops, except for bags "A" & "B" in the push-off Sequences II & III, wherein a schematic representation of their mating rear-front sides respectively are also included. It is further noted that the relative longitudinal positions of the stations are also schematically shown in the profile view of FIG. 2.

In the very initial portion of the machine a flattened bag is removed from the "Bag Caddy" by vacuum cup 52 and is then grasped by opposed vacuum cups 51 with a vacuum applied and the bag top opened by moving the cups 51 laterally apart. It is noted that when the illustrated vacuum cups 51, 52 are darkened in FIG. 1 a vacuum is applied, and when the illustrated vacuum cups 51', 52' are un-darkened no vacuum is applied. The opened bag is then positioned under the fill spout and held by the bag holder in the "Bag Hanger" station. (Note bag "D" in Sequences I, II and III and also the U.S. Pat. Nos. 3,698,451, 3,750,721 and 3,830,266 patents).

After the bag is filled (note bag "C" in Sequence I), the loaded bag with its top open is moved by the upper set 46' of the dual multiple finger pushers and pushed to the "Gusset Reform No. 1" station where the open tucking fingers 50 grasp the open, preformed gusseted top of the bag (not bag "B" in Sequence I). As the bag is moved forward by the lower set 46 of the dual set of multiple finger pushers, the tucking fingers 50' are closed, initially reforming the gusseted top of the loaded bag (not bag "B" in Sequences II and also the U.S. Pat. NO. 3,755,986 patent) until it is completely closed and the bag is in the entry portion of the in-feed device which serves as the "Gusset Reform No. 2" station (note bag "B" in Sequence III), where it is momentarily left sitting at the end of the support plate 45.

The tucking fingers 50' are withdrawn, opened and returned to the "Gusset Reform No. 1" station (note Sequence IV) as the dual set of multiple finger pushers 46, 46' (note the U.S. Pat. No. 3,796,300 patent), and the vacuum cups 51' are returned for another cycle. It is noted that in FIG. 1 when the tucking fingers are opened they are denominated with reference numeral 50, and when they are closed or partially closed they are denominated with reference numeral 50'; and when the multiple finger pushers are in their push position the arms are illustrated in a lateral direction across the flow path indicated by the large arrow, and when in their non-push position the arms are illustrated in the longitudinal, flow direction.

The preferred application of the method of the present invention centers around the movement of the bag from "Gusset Reform No. 1" station to "Gusset Reform No. 2" station, which is at the entry portion of the in-feed device, and then into the throat of the in-feed device (note bags "A" and "B" in Sequences II and III) between the kip pulley rollers 18, 21, and it is this action which will now be discussed in detail.

STRUCTURE AND OPERATION OF AUXILLIARY IN-FEED DEVICE

Figure 3:
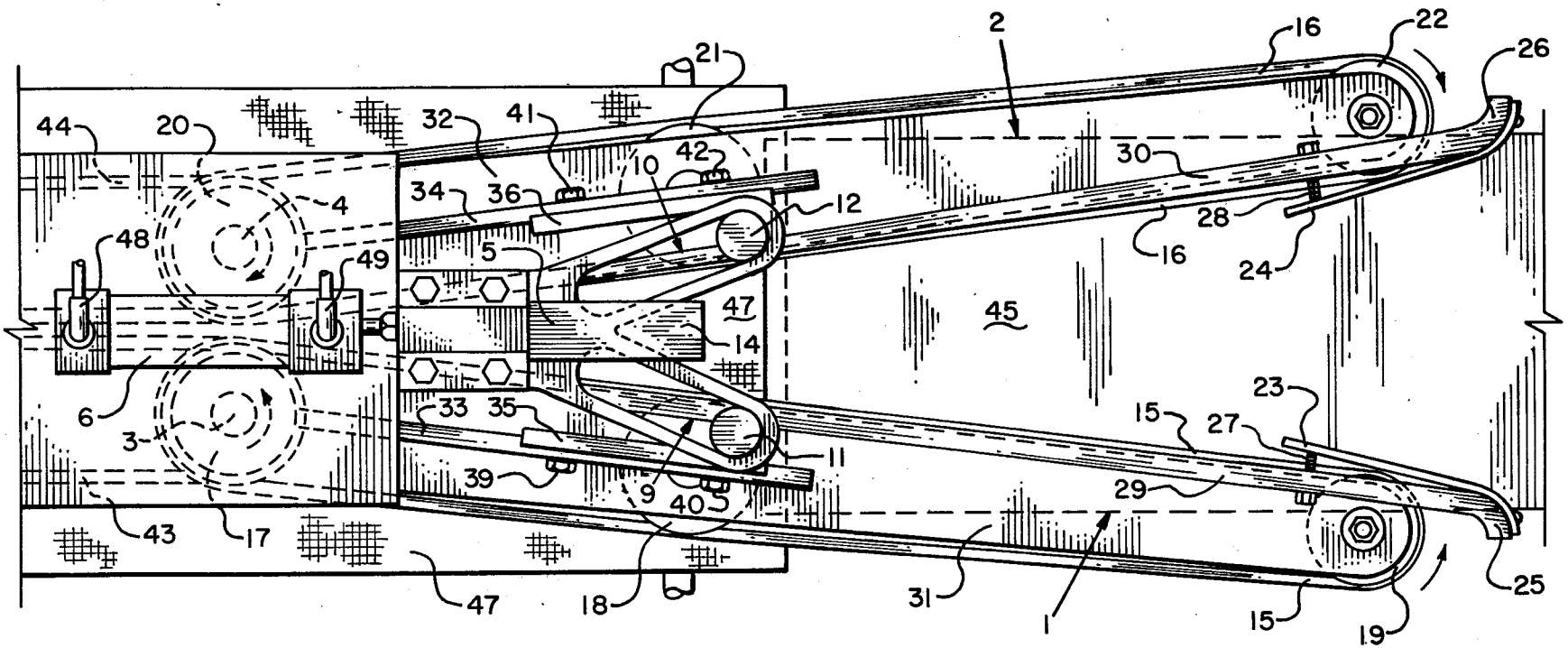
Figure 4:
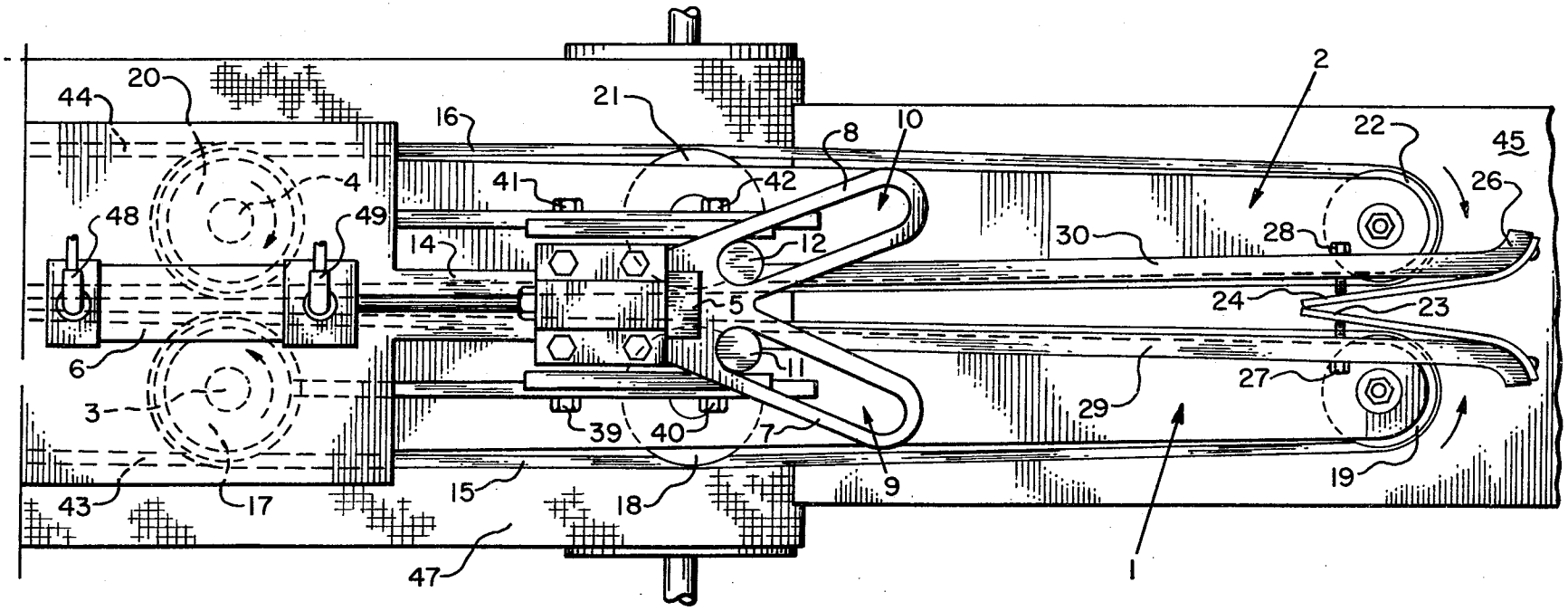
FIG. 4 is a top, plan view of the preferred embodiment of the in-feed section of FIG. 3, but with the inlet portion in its closed, parallel disposition, again no bag being shown for simplicity purposes.
Figure 5:
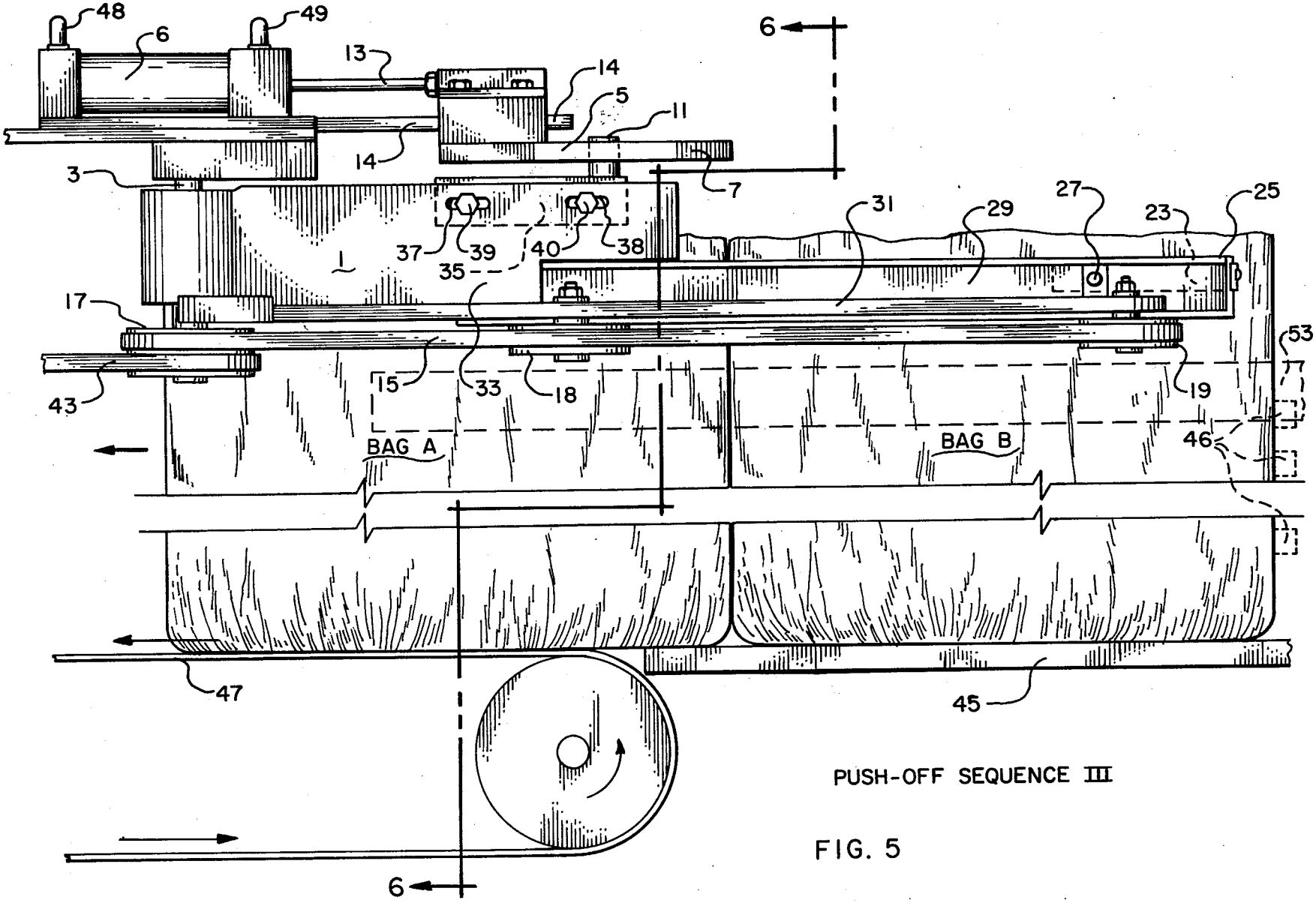
FIG. 5 is a side, partial view of the preferred embodiment of the in-feed section with the inlet portion being in its closed configuration, as illustrated in FIG. 4, showing a following bag in face-to-face side engagement with a preceding bag, the former pushing the latter off into the compressive belt section of the in-feed device.

With reference particularly to FIGS. 3 and 4, the preferred embodiment of the in-feed device, which serves as the preferred auxilliary element of the method of the present invention, includes two pivoted, opposed, in-feed arms 1 and 2, which pivot about axes 3 and 4, respectively. The in-feed pivot arms 1 and 2 are driven from their open/tapered disposition (FIG. 3) to their closed/parallel disposition (FIG. 4) and back again by means of a reciprocating yoke 5 driven by air cylinder 6.

The yoke 5 has two diverging arms 7 and 8 with slots 9 and 10 therein. Vertical pins 11 and 12 are fixedly attached to the pivot arms 1, 2 and ride in the slots 9, 10. The yoke 5 and the air cylinder 6, which are connected together by drive arm 13, are positioned horizontally in-line, along the center-line of the machine. Guide arm 14 serves to keep the yoke 5 in proper horizontal and lateral alignment as the yoke assembly moves longitudinally under the action of the air cylinder 6. As air cylinder 6 causes the yoke assembly to reciprocate forward (to the right in FIG. 1) and back (to the left in FIG. 2) in a longitudinal direction, vertical pins 11 and 12 riding in yoke slots 9, 10 cause the pivot arms 1, 2 to go from the open, tapered, inlet disposition of FIG. 1 to the closed, parallel, holding disposition of FIG. 4 and back open again.

The pivot arms 1, 2 carry dual, opposed conveyor belts 15 and 16, respectively, which provide moving contact surfaces for holding the tops of the bags as they are conveyed to the closing station.

The belts 15, 16, which are rubber V-belts, are endless and are each mounted on three vertically disposed rollers 17–19 and 20–22, respectively. The vertical axes of rotation of the back, exit rollers 17, 20, of the central rollers 18, 21 and of the front, entry rollers 19, 22 are mounted on the pivot arms 1, 2, respectively, and are in-line with each other on each arm. The central rollers 18, 21 form kip pulley rollers when the arms 1, 2 are in their closed parallel disposition.

However, although FIGS. 3–6 hereof are similar to FIGS. 1–4 of the U.S. Pat. No. 3,875,726 patent, it should be noted that, in comparison to the specific in-feed device described in the U.S. Pat. No. 3,875,726 patent, the position of the central, kip pulley rollers 18, 21 is approximately four inches further back from the front, entry rollers 19, 22 and correspondingly toward the back, exit rollers 17, 20. Additionally the terminal edge of the support trough or dead plate 45 and the initial edge of the conveyor belt 47 are located just short of the entrance nip of the kip pulley rollers 18, 21, in comparison to the more forward location in the U.S. Pat. No. 3,875,726 patent, so that a bag is not in conveying contact with the conveyor 47 of the present invention even though the bag is located in the entry portion of the in-feed device, that is between the two arms 1, 2 past the front, entry rollers 19, 22 but short of the kip pulley rollers 18, 21. The importance of this difference will become apparent in the discussion of the method of the present invention below.

Additionally, longitudinally extending, opposed static side guides 53 (shown in phantom line in FIGS. 5 and 6) are provided on both sides of at least the entry portion of the in-feed device and out to "Gusset Reform No. 1" station. The guides 53 are separated by a distance approximately equal to the depth of a filled or loaded bag and provide the desirable restraint on the face and back sides of the filled bag as it is moved to the in-feed device.

The diameters of the entry rollers 19, 22 are a little less than that of the other rollers so that, although the belts 15, 16 are substantially parallel to each other in the closed disposition of the pivot arms 1, 2 (FIG. 4) as they contact the bags, there is still a slight entry taper or gap in the forward, entry portion. This allows a bag to be located between and within the entry portion of the arms 1, 2 but out of compressive contact with the belts 15, 16. This gap also allows room for retarding finger straps 23 and 24 to contact the bag at the entry portion of the device to apply retarding pressure toward the rear of the bag which tends to stretch the top of the bag and eliminate any wrinkling that may occur when the sides (face and back) of the top of the bag are forced together by the belts 15, 16. The retarding finger straps 23, 24 which are directed back inwardly towards the throat of the closing station are made of resilient, springy material and are so mounted on the front, curved inlet portions 25, 26, respectively, of the device that they have an inherent tendency or bias to move away from the bag or outwardly toward the sides of the machines so as to bear against the tips or adjusting or set screws 27 and 28. The adjusting screws 27, 28 adjust the pressure applied on the bags and, when fully backed off, eliminate the retarding action as the finger straps 23, 24 will then lay flat against the sides of the pivot arm extensions 29, 30 out of contact with the bags. The retarding finger straps 23, 24 need not be used with all types of bags, but should be used with those bags that are relatively flimsy with a substantial tendency to wrinkle.

The pivot arm extensions 29, 30 and the horizontal support plates 31 and 32 are fixedly attached to the pivot posts 33 and 34, and all move together and form the pivot arms 1, 2. The vertical pins 11, 12 are mounted on and attached to the pivot posts 33, 34, respectively, by means of brackets 35 and 36. The brackets 35, 36 are longitudinally adjustable with respect to the pivot posts 33, 34 by means of adjusting slots 37 and 38 included therein and the co-operating locking screws 39 and 40, and 41 and 42. (It is noted that the adjusting slots in pivot post 34 can not be seen in the figures but are substantially identical to slots 37, 38).

The pivot arm extensions 29, 30 are made of channel iron and present opposing flat surfaces to each other when the pivot arms 1, 2 are closed. These flat surfaces are of course static when the pivot arms 1, 2 are closed and serve to further but only generally guide and position the top of the bag as the bag is moved through the in-feed device and into the closing station. In contrast to the static flat surfaces of the pivot arm extensions 29, 30 with only little or light contact with the bag top, the belts 15, 16 serve as moving contact surfaces in full face-to-face, compressive engagement with the bag top.

At the exit end of the belts 15, 16 at the back, exit rollers 17, 20, there is included a second set of contact belts 43 and 44 mounted on supports which are static or fixed with respect to one another during operation. These parallel feed belts 43, 44 are moving in contact with the bag top as it moves through the closing station (not specifically shown).

The bag as it moves through the initial sections of the machine and up to the entry portion of the in-feed device is supported on a static support pan or dead plate 45 (equivalent to the trough-shaped plate of FIG. 1 of U.S. Pat. No. 3,755,986) and is being pushed forward in cycles by means of two sets of multiple finger pushers 46, 46' (shown schematically in FIG. 1 and one set in phantom line in FIG. 5 and which are the subject matter of U.S. Pat. No. 3,796,300). As a bag is moved into the entry portion of the in-feed device, it contacts and pushes the preceding bag in face-to-face, front-rear side engagement therewith, in accordance with the principles of the present invention as described more fully below.

METHOD AND OPERATION OF PRESENT INVENTION

In accordance with the principles of the present invention, a bag after being loaded with loose materials and having its top at least partially closed, is moved forwardly from the rear only when at least its front side is constrained to counteract any tendency of the loose materials to shift within the bag and re-open the top, at least preferably until the top is fully closed for example by pivoting arms in a final in-feed device for a final closing station. It should be noted that the top of the bag can be initially formed preferably with gussets right before the in-feed device or the gussets of a preformed gusseted bag reformed; and the forming or reforming preferably achieved in stages by for example a first manipulation device with tucking fingers and then subsequently further formed and closed by pivoting in-feed arms. Finally the constrained movement of a loaded, at least partially closed bag is preferably combined with a push-off technique wherein the directly pushed bag pushes-off the preceding, constraining bag into the compressive throat of the in-feed device.

As best shown in FIG. 1 (Sequences II and III) and 5, the bag "A" sitting in the entry portion of the in-feed device is thus pushed off the dead plate 45 by means of the following bag "B" onto the horizontally disposed conveyor belt 47, which supports the bag, and between the central rollers 18, 21 of the in-feed device. The push-off bag is then conveyed by the conveyor 47 and, after the arms 1, 2 close, the belts 15, 16, and subsequently by the belts 43, 44, through the rest of the in-feed device and through the closing station. The belts 15, 16 and 43, 44 all move at the same linear speed as the conveyor belt 47 and maintain a gripping, compressive contact pressure on the top of the bag as it is moved past the closed kip pulley rollers 18, 21 supported by the bottom conveyor 47 and through the in-feed device and closing station. This linear speed is also identical to the linear speed of the multiple finger pushers 46, 46'.

As generally shown in FIG. 1 (Sequence II), the bag "A" is initially contacted by the following bag "B" under the action of the multiple finger pushers 46 while the in-feed device is in its open, tapered disposition. After preferably the top of bag "B" is fully within the entry portion of the in-feed device arms and the bag "A" is between the kip pulley rollers 18, 21, the arms 1, 2 close putting the top of the bag "A" under compression by means of the belts 15, 16. Thus bag "A" is pushed off the dead plate 45 and onto the moving conveyor belt 47 and subsequently is held under compression. As representationally shown in Sequence IV, the bag "A" is then passed through the in-feed device and into the final closing station (not illustrated) under the coordinated action of belts 15, 16, and belts 43, 44 and bottom conveyor 47.

Although a small amount of moving surface contact may occur between the belts 15, 16 as they passed to the kip pulley rollers 18, 21, with the leading edge of the bag "B", which is then sitting in the entry portion of the in-feed device, such contact is minimal if not nonexistent due to the initial taper of the belts even when the arms are closed because of the difference in roller diameters between the kip pulley rollers 18, 21 and the entrance rollers 19, 22.

In addition to the push-off aspect of the present invention, it is most important that a loaded bag, after having its top at least initially closed, not be substantially moved in a longitudinal direction except when its front side is under restraint, which restraint is achieved in the present invention by such a loaded bag being moved only when it is in face-to-face pushing engagement with an adjacent preceding bag. Thus, with particular reference to bags "A" and "B" in Sequences II and III, it should be noted that, as bag "B" is being moved forward by pusher element 46, its front side is coming to and is in face-to-face pushing engagement with the preceding bag "A". It should be further noted that Sequence II represents the bags just as they are initially coming into initial contact, and hence the facing sides of bags "A" and "B" are still rounded. However, as the bags come into full contact as bag "B" begins to push against bag "A" in full face-to-face pushing engagement, the facing sides become flattened, straight and square, substantially improving the squared off reforming of the gusseted tops. Were it not for the pushing engagement between the bags, each bag would have the rounded sides at the time when its top is finally closed, resulting in an inferior closing. The use of the present invention thus results in the elimination of the side pouches or rounding out of the bags prior to the final closing of the bag, achieving greater uniformity of closure performance than achieved in the prior art.

When the pivot arms 1, 2 close (the point shown in Sequence III of FIG. 1), the leading edge of the bag is just short of the two central, kip pulley rollers 18, 21, the belts 15, 16 are just short of gripping contact with the bag top, but the retarding finger straps 23, 24 are applying pressure to the central portions of the bag top.

It should be noted that with the preferred embodiment of the in-feed device described above, the bag gusset reformer (such as the one which is the subject matter of the U.S Pat. No. 3,755,986 patent) is operating on the bag in reforming the bag gussets right up to its entry into the in-feed device (note Sequence II and III). Indeed, the pivoting entry portion of the in-feed device serves as the final element ("Reform No. 2" station) in the complete reforming operation ("Gusset Reform No. 2" Station of FIGS. 1 and 2) by bringing together the gussets (which have been reformed by the moving fingers 50) and the face and the back of the bag when the pivot arms 1, 2 are initially closed. In fact this closing or scissoring action of the pivoting arms at their forward portion serve to gently fold the main panels of the bag in addition to the preformed gusset lines.

Figure 7:
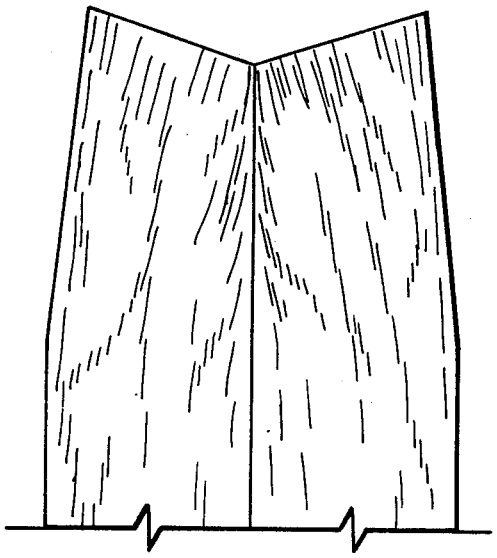
Figure 8:
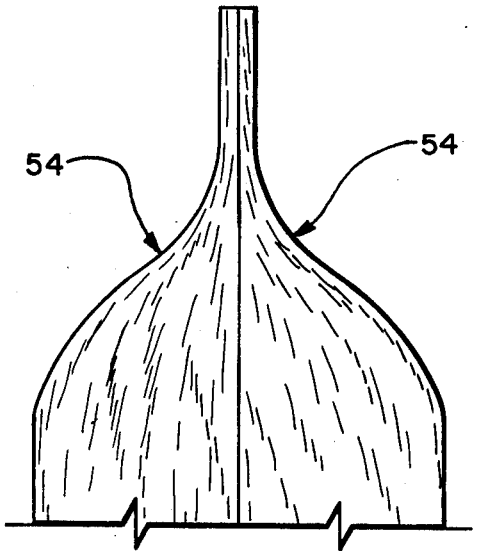
FIG. 8 is a schematic representation of the configuration of the top side of a bag which has had its gusseted top not only initially reformed as in FIG. 7 but also further closed by the pivoting in-feed arms of the in-feed device of "Reform No. 2" station.

With reference to FIGS. 7 and 8, the tucking fingers reform only the pre-formed gusset lines themselves, and accordingly the top of the bag, if left to itself without any restraint, would assume the "natural" position shown in FIG. 7. The "Gusset Reform No. 1" thus serves to grossly position and form the top. Then, by pivoting the arm 1, 2 closed after a bag is in the entry portion of the in-feed device, new gentle folds 54 are introduced and formed at the top along the length of the gusseted top, as shown in FIG. 8, further closing and forming the top in a relatively final, exact way. Thus, even if the bag top would then be left unrestrained, it would at least generally maintain the closed disposition of FIG. 8 as compared to the open "natural" state of FIG. 7. It is most preferred in the present invention that the face-to-face pushing engagement between adjacent bags occur at least between the point where the bag top has been initially reformed to the point where the final reforming is set for proper staged reforming prior to final sealing.

Thus an over-all superior closing operation is further achieved in the present invention. The gradual closing of the bag (with an adequate amount of bag material above the bag fill line of the product) and sufficient time provided for the work to be done upon the upper portion of the bag by the various components of the machine enhances the uniform wrinkle free closure obtained with the use of the present invention.

When a bag is actually engaged by the central, kip pulley rollers 18, 21, the co-operative action which is produced on the bag by the moving belts 15, 16, the static finger straps 23, 24 and the bottom conveyor 47 prevents wrinkles from occurring in the bag top and porperly positions and maintains the alignment of the bag top for closing. It should be further noted that the initial contact between the belts 15, 16 and the bag top is a point contact (because of the pivoting action and the taper of the entry portion of the in-feed device) rather than an immediate face-to-face contact and that this point contact occurs at or in proximity to the leading edge of the bag.

With the pivot arms 1, 2 closed and the bag "A" having been pushed off by bag "B" in Sequence II going to Sequence III and being conveyed by the bottom conveyor 47, the initial point contact then in a continuous manner becomes a full line, face-to-face contact throughout the bag length. This action plays a significant role in the superior results achieved by the in-feed device which forms the preferred auxilliary element in the method of the present invention.

After the conveyor belt 47 moves the bag through the in-feed device and into the closing station where the belts 43, 44 are then in contact with the bag top, the pivot arms 1, 2 are reopened by the air cylinder 6 being actuated through air line 49. In the meantime, multiple finger pushers 46 have retracted, engaged the next bag, and moved back again to its most forward position, bringing another bag into the entry of the in-feed device but short of the central, kip pulley rollers 18, 21, which bag pushes off the preceding bag, and the cycle is repeated.

In summary then, in the in-feeding operation itself, the bag is fed from static rails and supports to a movable tapered in-feed conveyor wherein the conveyors grab the bag in a point contact when the bag is between the kip pulley rollers of the in-feed device. When the transfer is made into the throat of the closed, parallel conveyors and a bag is substantially into the fixed, parallel conveyors for the closing station, the pivot arms open up to accept the next, pushing bag. It is noted that in the preferred embodiment illustrated the bags are approximately 10 inches apart in the initial portions of the machine, moving at about 32 feet per minute, and the bags have a face width of approximately 16 inches and a height of approximately 24 inches and are to be sealed with a plastic resin by being passed through a heating element in the closing station.

Thus, in the present invention after the bag is pushed-off by the following bag, the kip pulley rollers of the in-feed device grasp a leading portion of the bag with compressive conveyor belts while the bottom of the bag is being moved on a moving bottom conveyor off the dead plate, and the bag is finally closed.

GENERAL DISCUSSION OF EXEMPLARY VARIATIONS

Although the mechanism and method steps described in detail supra has been found to be most satifactory and preferred, many variations are of course possible. For example, rather than use the single air cylinder 6 and yoke/pin assembly 5/11–12, two separate opposed, diagonally disposed air cylinders could be used, one on each pivot arm.

Also, because the belts 15, 16 do not come into any substantial contact with the bag until the belts pass over the central, kip pulley rollers 18, 20, the lead or entry rollers 19, 22 could be positioned further back on the support plates 31, 32 closer to the central rollers 18, 20. Indeed, the entry rollers conceivably could be eliminated, but their presence produces a better, more graduated taper or angular contact in the initial contact between the belts and the bag. In fact, the moving belts could be completely eliminated and static but pivotable guide arms used, as long as the arms maintain the top of the bags under compression as they pass through the in-feed device and into the closing station so as to maintain the reformed gusseted top in their final closed position. With such a substitution, the pivoting guides without moving contact surface would look just like arms 1, 2 described above except with the belts 15, 16 and their rollers 17–22 removed, with the members 29 and 30 serving as the guides.

Additionally, other detailed mechanisms can be added to the in-feed device, such as for example a belt tensioning system, etc. Moreover, it is conceivable that one of the pivot arms could be static or fixed while the other one is the only one that is moved or pivoted to present the open and closed configurations, and such an approach, although considered inferior, would be within the broadest concept of the present invention as an equivalent variation.

The above are of course merely exemplary of the possible changes or variations.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed as invention is:

1. The method of feeding non-rigid wall bags loaded with loose granular solid materials and having gusseted tops, which have been initially but not finally closed, on a one-by-one in-line basis into a machine wherein the bag tops are comprised of facing sheets of flat, flexible, non-rigid material which need to be properly aligned for further processing, such as for example the top of a bag being finally closed, comprising the following steps:

a. providing a bag handling machine including an in-feed device for the bags having an entry portion comprising two opposed members mounted on opposite sides of the center-line of the machine forming the throat of the in-feed device and located at the level of the bag tops, and a pusher conveying system associated with said in-feed device;

b. individually conveying each bag loaded with said granular solid material through an initial portion of the machine by means of a first pushing element of said pusher conveying system, while maintaining the bag free of contact with an adjacent loaded bags; but then conveying each bag loaded with said granular solid material to the entry portion of the in-feed device by pushing said non-rigid wall bag at its rear by means of a second pushing element of said pusher conveyor system while the bag is in face-to-face pushing engagement along its front side with the rear side of a preceding bag, the bag being pushed by the pushing element at its rear side, thereby being constrained at its front side by the preceding bag by means of said pushing engagement; whereby any tendency of said load of granular solid material to shift within the bag and open the initially closed gusseted top is reduced;

c. subsequently pushing off said non-rigid wall bag located at the entry portion of the in-feed device into the throat of said in-feed device, with said opposed members contacting the bag top under compression, by means of a following bag contacting the rear side of the bag in face to face engagement and moving said following bag forward, and hence the preceding bag, by said second pusher element;

d. individually conveying the pushed-off bag with its rear side out of contact with the following bag with the top under compression through the in-feed device to the next processing station of the machine; and e. cyclically repeating steps "b"-"d" for the following bags in-line with the preceding ones.

2. The method of claim 1 wherein the step *a* said two opposed members of the in-feed device are further provided with extensions forward of their throat portion and are mounted for opposed pivoting movement away from and toward each other, whereby they can present an initial, tapered open disposition and then a closed, at least substantially parallel disposition; and wherein there is further included the steps of:

i. opening said two pivoted opposed members prior to the entry of each bag into the inlet portion of the in-feed device; and ii. closing said two pivoted opposed members together against the top of the bag after each bag has entered into the inlet portion but before it enters the throat of the in-feed device, thereby compressing the bag top, further forming and closing the bag top by forming longitudinal creases along the gusseted top.

3. The method of claim 2 wherein in step *a* said two opposed members of the in-feed device are further provided with opposed movable contact surfaces along their length; and wherein in step *d* said contact surfaces assist in the conveying of the pushed-off bag after the bag is pushed off into the throat of said in-feed device in step *c*.

4. The method of claim 2 wherein in step *a* said two opposed members are pivotable but otherwise static guides having no moving contact surfaces along their opposing faces.

5. The method of claim 3 wherein in step *a* said two opposed members are provided with kip pulley rollers at the entrance to the throat of said in-feed device; and wherein in step *b* said bag loaded with said granular solid material is pushed into the entry portion of said in-feed device between the forward extensions of said opposed members but just short of said kip pulley rollers.

6. The method of claim 5 wherein in step *b* the bottom of said bag loaded with said granular solid material is always supported on a static support; and wherein in step *d* the bottom of the bag is always supported on a moving conveyor; the terminal edge of said static support ending just short of the kip pulley rollers and the beginning edge of the moving conveyor located at the terminal edge of said static support.

7. The method of claim 2 wherein in step *a* there is further provided a gusset former located forward of said in-feed device; and wherein there is further included immediately before or in conjunction with step *a* the step of forming and initially closing the gusseted top of the loaded bag with said gusset former, and thereafter substantially moving the formed, initially closed bag forward only when in contact with the preceding bag in face-to-face rear-front side pushing engagement with the preceding bag until at least the initially closed bag top is further closed and creased by the closing pivoting of said two opposed members of said in-feed device.

8. The method of claim 1 wherein in step *a* longitudinal side guides and a bottom static support are provided for the sides and bottom of the bags, respectively, said side guides and bottom support extending forward of the in-feed device and up to the entry portion of, but at least in the case of said static bottom support, short of the throat of said in-feed device; and wherein in step *b* there is further included the step of:

said bag loaded with said granular solid material being constrained on all four of its sides by the combination of said preceding bag, said side guides and said second pushing element, and on its bottom by said bottom support; whereby the counteraction against any tendency of the loaded material to shift within the bag and open the initially closed gusseted top is further enhanced.

9. The method of claim 1 wherein said bottom support is static and wherein in step *a* there is further provided at the terminal end of said static bottom support a conveying and support system which conveys and supports a bag by means of moving contact surfaces; and wherein in step *b* said preceding loaded bag is located at the end of said static bottom support; and wherein in step *c* said preceding bag is pushed-off said static bottom support to said conveying and support system by said one loaded bag being pushed at its rear by said second pushing element.

10. The method of claim 1 wherein in step *b* the bottom of said loaded bag is supported on a static support, and wherein in step *d* the bottom of the bag is supported on a moving conveyor; the terminal edge of said static support ending at said moving conveyor; and wherein there is further included between steps *b* and *c* the step of allowing the loaded bag to rest on the terminal edge of said static while it awaits the next cycle and is itself pushed-off by the following loaded bag.

* * * * *